US005438930A

United States Patent [19]

Grosswendt et al.

[11] Patent Number: 5,438,930

[45] Date of Patent: Aug. 8, 1995

[54] MINE

[75] Inventors: Werner Grosswendt, Ratingen; Klaus Gersbach, Willich; Joachim Fiebrich, Düsseldorf, all of Germany

[73] Assignee: Rheinmetall GmbH, Ratingen, Germany

[21] Appl. No.: 301,907

[22] Filed: Sep. 7, 1994

[30] Foreign Application Priority Data

Sep. 8, 1993 [DE] Germany ..... 43 30 414.1

[51] Int. Cl.[6] ..... F42B 23/00

[52] U.S. Cl. ..... 102/404

[58] Field of Search ..... 102/401, 404, 405

[56] References Cited

U.S. PATENT DOCUMENTS 4,919,051 4/1990 Cohen ..... 102/404
5,279,229 1/1994 Bredy et al. ..... 104/404

FOREIGN PATENT DOCUMENTS 4034618 5/1992 Germany .
4041767 6/1992 Germany .
4131875 4/1993 Germany .

*Primary Examiner*—Charles T. Jordan
*Assistant Examiner*—Theresa M. Wesson
*Attorney, Agent, or Firm*—Spencer, Frank & Schneider

[57] ABSTRACT

The invention relates to a mine with at least one ejectable sub-munitions body disposed in a cup-shaped starting device and with a propulsion device for propelling the sub-munitions body into a selectable altitude range. For achieving that the propulsion device requires only a small structural volume, entails low cost because of the use of reduced amounts of propulsion charges and in addition operates safely and dependably. It has been proposed to dispose the propulsion device not in or on the sub-munitions body, but in the bottom part of the cup-shaped starting device. In this case the propulsion device advantageously consists of a high pressure chamber facing the bottom of the starting device, in which the propellant charge is contained, and of a low pressure chamber facing the sub-munitions body. The high pressure and low pressure chambers are separated from each other by a perforated plate provided with jets (holes).

6 Claims, 1 Drawing Sheet

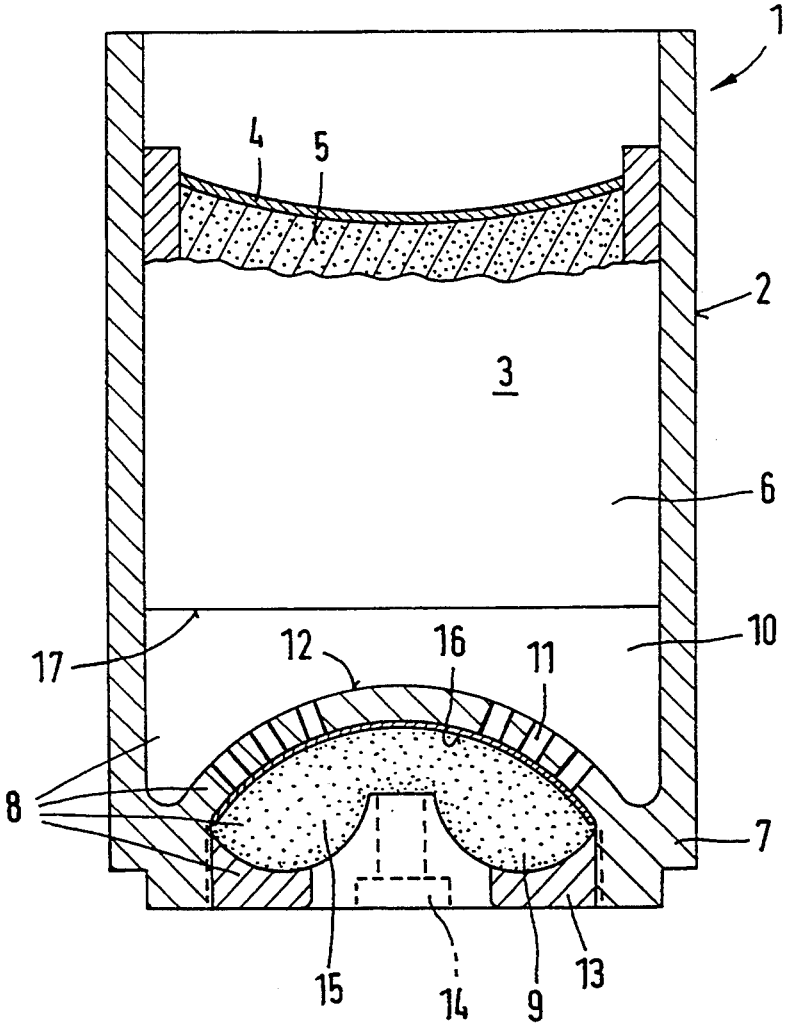
1
4
5
2
3
6
10
17
12
16
11
8
7
15
14
9
13

MINE

BACKGROUND OF THE INVENTION

The invention relates to a mine with at least one ejectable sub-munitions body.

A mine of this type is known, for example, from German Published, Non-Examined Patent Applications DE 40 34 618 A1, DE 40 41 767 A1 and DE 41 31 875 A1. It is used to combat enemy armor and also to combat low-flying helicopters and essentially consists of an ejectable sub-munitions body provided with a seeker fuse as well as a cup-shaped starting device. After sensing an enemy target, the sub-munitions projectile is propelled from the starting device to a sufficient altitude of, for example, 200 m, from where the sub-munition then is lowered suspended from a parachute and in the process searches the ground for the target, for example in a helical pattern. As soon as the target has been detected by the sub-munitions projectile, the latter generates a projectile flying in the direction of the target, for example by explosive deformation of a projectile-forming liner.

The known mines of the type in accordance with the species have the particular disadvantage that the respective sub-munitions projectile must have a propulsion device (rocket propulsion) for propelling it to the intended altitude. This requires a relatively large structural volume of the sub-munitions projectiles. In addition, such rocket propulsion devices are relatively expensive to manufacture. Finally, the sidewalls of the cup-shaped starting devices of the known mines must have exhaust gas opening for preventing too great an initial acceleration, which could result in danger to the immediate vicinity of the mine when the sub-munitions projectile starts up.

SUMMARY OF THE INVENTION

It is therefore the object of the invention to recite a mine of the type mentioned at the outset, having a propulsion device requiring a small structural volume which entails little expense because of the use of reduced amounts of propellant charges and furthermore operates safely and dependably.

The invention essentially is based on the concept of not disposing the propulsion device in the sub-munitions body, but in the bottom part of the cup-shaped starting device. In an advantageous manner, in this case the propulsion device consists of a high pressure chamber facing the bottom of the starting device, in which the powder of the propellant charge is contained, and a low pressure chamber facing the sub-munitions body. The high pressure and low pressure chambers are separated from each other by a common wall provided with jets (holes).

Such an arrangement has the advantage that on the one hand a complete conversion of the powder under high pressure is assured by burning the powder in the high pressure chamber. When entering the low pressure chamber, the powder gases are slowed by the jets, so that a predeterminable slow starting speed of the sub-munitions body can be achieved in spite of the complete burning of the powder.

A particularly rugged and dependably operating propulsion device is obtained if the propulsion device is integrated into the bottom of the cup-shaped starting device. In this case the high pressure chamber is constituted by an appropriate chamber provided in the bottom, whose wall facing away from the sub-munitions body is closed by means of a screw lid. The wall of the high pressure chamber facing the sub-munitions body, however, is embodied as a perforated plate, so that the low pressure chamber of the propulsion device is formed by the chamber between the perforated plate and the bottom of the sub-munitions body located in the cup-shaped starting device.

To achieve as complete as possible burning of the propulsion charge powder in as small as possible a space, it has furthermore been found to be advantageous to embody the perforated plate and, if required, also the wall of the high pressure chamber located opposite the perforated plate, to be arched toward the exterior.

BRIEF DESCRIPTION OF THE DRAWING

The sole drawing FIGURE shows a mine according to the invention.

DETAILED DESCRIPTION OF THE INVENTION

Further details and advantages of the invention ensue from the exemplary embodiment below, which will be described by means of a drawing FIGURE:

A seeker fuse mine is schematically indicated by 1, in which for reasons of clarity details not relevant to the invention have been left out, such as the sensor and electronic components of the mine as well as the mounting elements which maintain the mine approximately in the vertical. The mine 1 essentially consists of a cup-shaped starting device 2 and an ejectable sub-munitions body 3 located therein.

On its front end the sub-munitions body 3 has a projectile-forming liner 4, which is followed by an explosive 5 for the explosive deformation of the liner 4. Furthermore, in a manner known per se, a rotary parachute and the electronics for the sensor devices, also not shown, of the sub-munitions body 3 are also housed inside the housing 6 enclosing the sub-munitions body 3.

In accordance with the invention, the cup-shaped starting device has a propulsion device 8 in the area of its bottom 7 for ejecting the sub-munitions body 3. The propulsion device 8 essentially comprises a high pressure chamber 9 and a low pressure chamber 10 located above it. The high pressure and low pressure chamber 9 and 10 are separated by an arched perforated plate 12, which is provided with jets (holes) 11 and forms the inner wall of the bottom 7.

On the side located opposite the perforated plate 12, the high pressure chamber 9 is closed off by a screw lid 13. A propulsion charge fuse 14, indicated by dashed lines, has been screwed into this lid 13. The propulsion charge 15 necessary for accelerating the sub-munitions body 3 is located in the high pressure chamber 9 proper. A thin rupture foil 16 is provided so that the charge cannot get into the low pressure chamber 10 through the jets 11 when the mine 1 is being transported (it is also possible to insert combustible plugs into the jet openings in place of the rupture foil).

In the present exemplary embodiment, the low pressure chamber 10 is formed by the chamber between the perforated plate 12 and the bottom 17 of the sub-munitions body.

The mode of operation of the mine 1 of the invention will be described in what follows:

As soon as the mine 1 detects the seismic vibrations of the ground which are typical for a heavy tracked vehicle by means of the proximity sensors, the propulsion charge 15 is ignited via the electronic devices of the mine and the propulsion charge fuse 14. Because of the high gas pressure forming in the high pressure chamber 9 (for example 700 bar), the rupture foil 16 burns and the propulsion charge gas gets from the high pressure chamber 9 into the low pressure chamber 10, wherein the gas pressure is reduced (for example to 300 bar) in accordance with the diameter of the jets and the dimensions of the chamber 9 and 10.

The bottom 17 of the sub-munitions body 3 is now charged with the appropriately throttled propulsion charge gases. This, in turn, results in the shearing of a rated breaking point of the mine lid (not shown) closing off the cup-shaped starting device above the sub-munitions body 3, and the sub-munitions body 3 starts out of the cup-shaped starting device 2. In an appropriate exemplary embodiment (propulsion charge mass: 55 g; gas pressure in the high pressure chamber: 700 bar; gas pressure in the low pressure chamber 300 bar), the velocity of the sub-munitions body 3 when leaving the cup-shaped starting device 2 was approximately 80 m/s.

What is claimed is:

1. A mine having at least one ejectable sub-munitions body disposed in a cup-shaped starting device, and a propulsion device for propelling the sub-munitions body into a selectable altitude range, wherein:

the propulsion device forms a part of the cup-shaped starting device at a bottom region of the cup-shaped starting device;

the propulsion device comprises a high pressure chamber facing a bottom of the cup-shaped starting device and having a propulsion charge located therein; and an adjoining low pressure chamber facing a bottom of the sub-munitions body; and the high pressure chamber and the low pressure chamber are separated from each other by a perforated plate.

2. A mine having at least one ejectable sub-munitions body disposed in a cup-shaped starting device, and a propulsion device for propelling the sub-munitions body into a selectable altitude range, wherein:

the propulsion device forms a part of the cup-shaped starting device at a bottom region of the cup-shaped starting device;

the propulsion device comprises a high pressure chamber facing a bottom of the cup-shaped starting device and having a propulsion charge located therein; and an adjoining low pressure chamber facing a bottom of the sub-munitions body;

the high pressure chamber and the low pressure chamber are separated from each other by a perforated plate; and the high pressure chamber is formed with the bottom of the cup-shaped starting device, a wall of the bottom of the cup-shaped starting device which faces the low pressure chamber comprising the perforated plate, and a wall of the high pressure chamber located opposite the perforated plate being at least partially closed off by a screw lid.

3. A mine in accordance with claim 1, wherein the perforated plate is arched toward the low pressure chamber.

4. A mine in accordance with claim 2, wherein a propulsion charge fuse is disposed so that it can be screwed into the screw lid.

5. A mine in accordance claim 4, wherein the wall of the high pressure chamber is arched, and wherein an arch of the wall of the high-pressure chamber is most pronounced in a center region between the propulsion charge fuse and an edge of the screw lid.

6. A mine in accordance with claim 1, wherein a rupture foil is disposed in the high pressure chamber directly in front of the perforated plate.

* * * * *